United States Patent [19]

Fuller

[11] 4,332,549

[45] Jun. 1, 1982

[54] GAS PRESSURE REGULATOR FOR LIGHTERS

[75] Inventor: David L. Fuller, Atlanta, Ga.

[73] Assignee: Scripto, Inc., Doraville, Ga.

[21] Appl. No.: 948,432

[22] Filed: Oct. 4, 1978

[51] Int. Cl.[3] ..... F15D 1/00; F23Q 2/16

[52] U.S. Cl. ..... 431/344; 431/277; 138/43; 138/46

[58] Field of Search ..... 431/130, 131, 142, 143, 431/150, 254, 255, 276, 277, 344; 138/40, 42, 44, 45, 46, 43

[56] References Cited

U.S. PATENT DOCUMENTS

| | | | |
|---|---|---|---|
| 1,964,300 | 6/1934 | Perry et al. | 138/42 |
| 2,021,079 | 11/1935 | Mittendorf et al. | 138/42 |
| 2,662,590 | 12/1953 | Reich | 138/42 |
| 3,092,988 | 6/1963 | Meyers | 431/150 |
| 3,118,295 | 1/1964 | Van Poppel | 431/131 |
| 3,696,841 | 10/1972 | Arsenius | 138/42 |
| 3,860,385 | 1/1975 | Nakanishi | 431/344 |
| 3,963,413 | 6/1976 | Lockwood et al. | 431/344 |

*Primary Examiner*—Carroll B. Dority, Jr.

*Attorney, Agent, or Firm*—Newton, Hopkins & Ormsby

[57] ABSTRACT

A gas pressure regulator for a butane lighter or other gas burner is created by the interaction of two superposed washers and an underlying flat retainer disc. A compressed elastomeric washer exerts pressure on a more rigid washer having a distal textured face in contact with an opposing face of the retainer disc. Gas flows through the interstitial array between said textured face and the opposing face of the retainer disc and a net pressure differential is effected.

12 Claims, 8 Drawing Figures

GAS PRESSURE REGULATOR FOR LIGHTERS

BACKGROUND OF THE INVENTION

Regulators designed for use in pressurized gas lighters generally operate on the principle of passing gas through a compressed filter medium placed upstream of the shut-off plug or washer of the lighter. The filtering medium offers resistance to the flow of gas causing a drop in pressure.

Several materials are currently used for filtering, including plastic fiber matrices, plastic foam and porous plastics. The most common form of construction is one which compresses the filter material between plates during assembly. The effective pressure drop across the regulator can then be further adjusted by compressing or decompressing the filter in order to vary its average pore size.

One of the major problems with such an arrangement is that the characteristics of the filter medium will continue to undergo changes over a period of time, even though there are no mechanical changes in the relationship of the parts. This effect is called "creep" and is particularly troublesome and hard to predict and control with the highly elastic plastics materials of which most regulators are constructed.

The objective of this invention is to alleviate the above problems in the prior art through the provision of a simple and economical regulator means which is efficient in its operation on a constant basis over a long period of time without changing its physical or its operational characteristics. The invention departs from the traditional practice of employing a bulk porous filter medium and in lieu thereof employs a surface effect regulator in which the gas is forced to flow through a multiplicity of interstices of a textured surface element. The resulting pressure regulation is consistent and the problem of "creep", above noted, is entirely absent.

Other features and advantages of the invention will also become apparent during the course of the following description.

To comply with the duty to disclose known prior art under 37 C.F.R. 1.56, the following United States patents and one French patent are made of record herein Nos.:

2,126,991
3,523,005
3,533,721
3,709,462
3,820,941
3,859,037
3,860,385
3,922,139
3,036,579
1,057,471—(French)

SUMMARY OF THE INVENTION

The invention herein relies on surface effects rather than bulk effects to achieve the desired regulation. An appropriately textured rigid surface element is pressed against a smooth rigid surface element, whereupon the interstitial array between the two surfaces provides the regulating function. The two mating surfaces that form the interstitial array are selected from materials that are impervious to the flow of gas therethrough.

With this arrangement, the problems associated with the elastic and plastic deformation of the regulator over a period of time are substantially eliminated because of the use of essentially rigid components. An additional benefit of such a construction is that the regulator is simpler to assemble in mass production and provides much more consistent performance for such applications as pressurized gas lighters, burners and the like.

DETAILED DESCRIPTION

Figure 1:
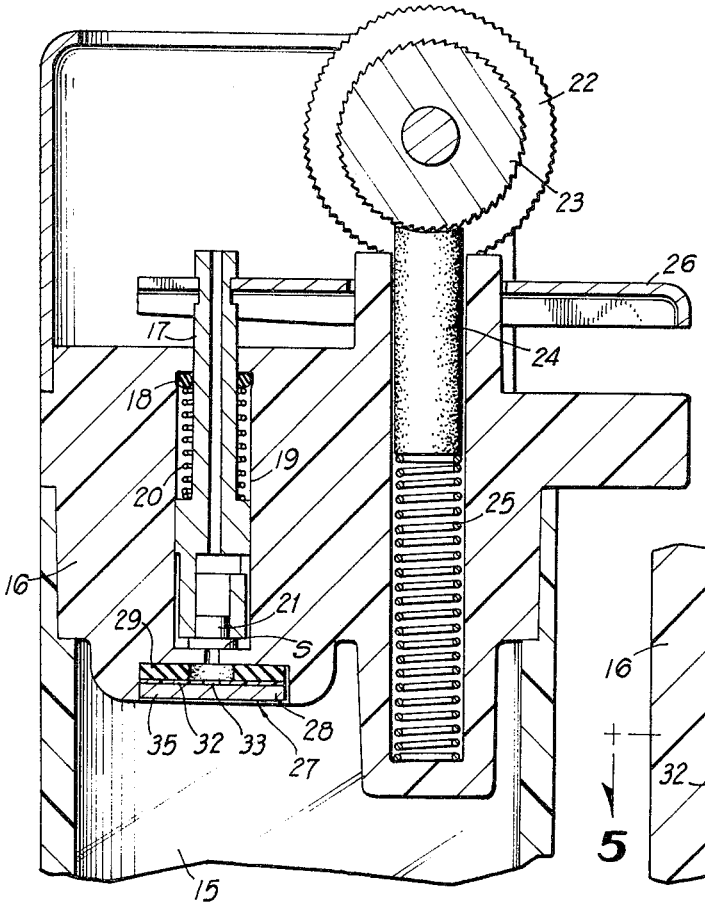
FIG. 1 is a fragmentary cross sectional view showing the gas pressure regulator in accordance with the invention applied to a butane lighter.

Referring to the drawings in detail, wherein like numerals designate like parts, FIG. 1 depicts a generally conventional butane lighter including a tank 15 closed at its top by a plug body 16. A valve stem 17 is sealed at 18 within a bore 19 of the plug body and is urged with shut-off plug 21 by a stem spring 20 into engagement with valve seat S. A side wheel 22 is manually operated to rotate a spark wheel 23 which engages a flint 24 biased by a spring 25 in the plug body toward the spark wheel. A valve lever 26 is operatively connected to the valve stem 17 in the manner shown. A gas pressure regulator 27 forming the essential subject matter of the invention, to be fully described, is contained in a cavity 28 formed in the bottom of plug body 16.

Figure 2:
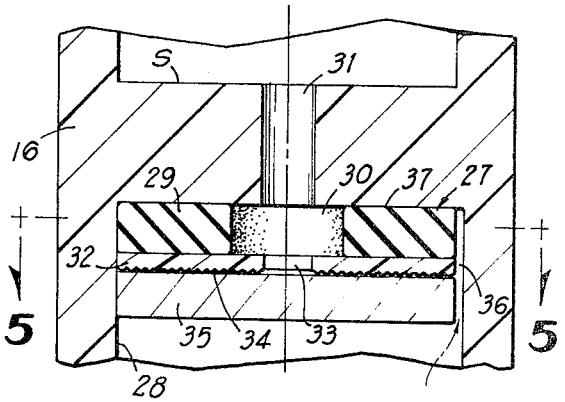
FIG. 2 is an enlarged cross sectional view of the basic regulator.

Referring to FIG. 2, the regulator 27 according to the basic embodiment of the invention comprises a first washer 29 of elastomeric material such as Vinton rubber or equivalent material. The outside diameter of the washer 29 is slightly less than the diameter of the cavity 28. The washer 29 has a central opening 30 formed therethrough in registration with a central axial port 31 in the end wall of the cavity 28.

A second or intermediate essentially rigid washer 32 is disposed within the cavity 28 against the first washer 29 and may be formed of matte finish Mylar or the like. The outside diameter of the washer 32 is nearly equal to the cavity diameter and the washer 32 has a central opening 33 smaller than the opening 30 and in registration therewith. The face of the intermediate washer 32 next to the washer 29 is smooth and flat and its opposite face away from the washer 29 indicated at 34 is a textured face defining a multiplicity of minute interstices.

The regulator 27 further comprises a rigid retainer disc 35 formed of aluminum and being imperforate and having an outside diameter larger than the diameter of cavity 28 so that the retainer disc has an interference fit in the cavity bore and is fixed therein. In the embodiment of FIG. 2, the face of the retainer disc 35 directly opposing and contacting the textured face 34 is smooth and flat. In the assembled regulator 27, the placement of the disc 35 is such that the elastomeric washer 29 is always under compression.

Figure 5:
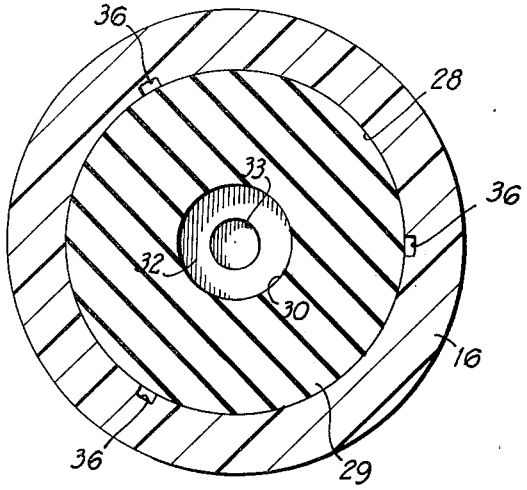
FIG. 5 is a horizontal section taken on line 5—5 of FIG. 2.
Figure 6:
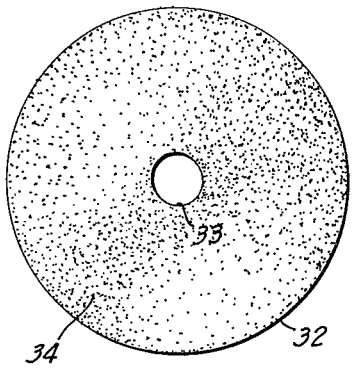
FIG. 6 is a plan view of a rigid intermediate washer showing the textured face thereof.

The cylindrical cavity 28 has one or more side wall grooves 36 formed therein, FIG. 5, in circumferentially spaced relationship. The end wall 37 of the cavity 28 against which the washer 29 seats is smooth and flat with the port 31 leading therefrom to the low pressure side of the regulator. Preferably, the plug body 16 containing the cavity 28 is formed of molded thermoplastic such as nylon and the plug body is rigid.

Figure 3:
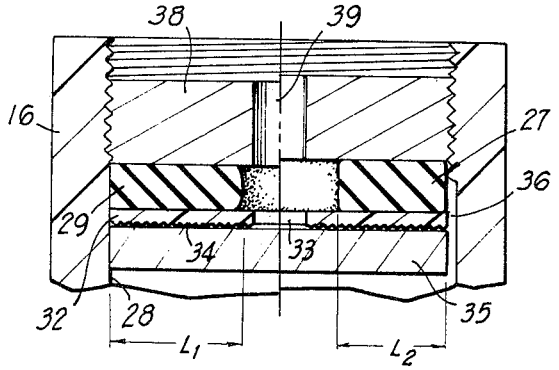
FIG. 3 is a composite cross section taken through a regulator according to a modification.

FIG. 3 shows a modification of the invention in which the regulator is adjustable so that the pressure drop in the gas flowing therethrough can be varied. To accomplish this, the end wall of cavity 28 against which the elastomeric washer 29 is seated is formed by a threaded plug 38 which is adjustable axially relative to the regulator assembly 27. The assembly 27 is composed of the same elements 29, 32 and 35, previously described. The plug 38 has a central axial through port 39 which is identical to the port 31.

The degree of compression on the elastomer washer 29 can be increased by adjusting the plug 38 inwardly as at the left hand side of FIG. 3, or decreased by adjusting the plug outwardly as at the right hand side of FIG. 3. The degree of pressure drop in the gas flowing across the interface between the disc 35 and textured washer 32 is proportional to the length L of the gas flow path. Thus, when compression of the washer 29 is increased, it extrudes radially inwardly increasing the flow path distance $L_1$ in comparison to the smaller distance $L_2$. FIG. 3, when there is less compression on the washer 29, as at the right hand side of FIG. 3. It follows, therefore, that a larger pressure drop will be exhibited in gas flowing through the longer path $L_1$ than is the case when gas flows through the comparatively shorter path $L_2$.

Figure 4:
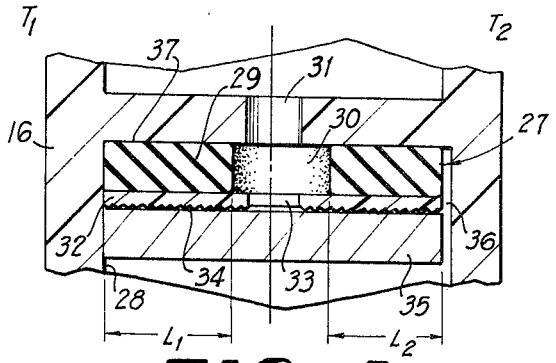
FIG. 4 is a similar view in cross section taken through a regulator according to another modification.

In another variant of the invention shown in FIG. 4, the operation of the regulator assembly 21 can be rendered automatically adjustable in response to temperature variations, eliminating the need for the threaded plug 38 of FIG. 3. This is done by utilizing a material in the elastomer washer 29 having a significantly larger coefficient of expansion than the adjacent materials of the regulator. Therefore, at a higher temperature $T_1$, the washer 29 will expand inwardly as at the left hand side of FIG. 4, to produce the longer flow path $L_1$ and a larger gas pressure drop through the regulator. At a lower temperature $T_2$, there is less expansion of the washer 29, giving a shorter gas flow path $L_2$ and a lesser pressure drop.

Figure 7:
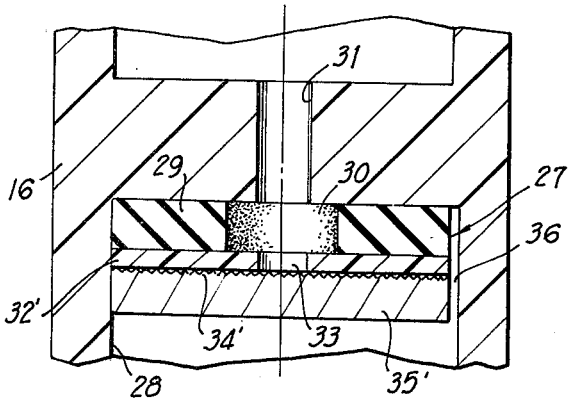
FIG. 7 is a cross sectional view similar to FIG. 2 showing a variation of the invention in which the intermediate washer has two smooth faces and the opposing face of the retainer disc is textured.
Figure 8:
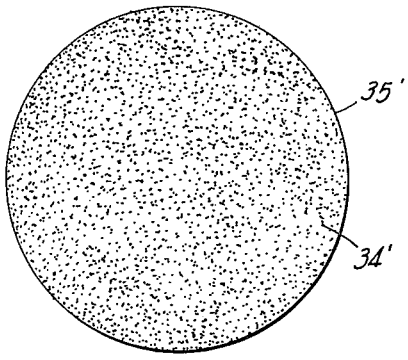
FIG. 8 is a plan view of the textured face of the retainer disc.

Some other variations of the invention are possible and these can be explained with reference to FIGS. 7 and 8. For example, the intermediate rigid washer 32' can be made smooth on both sides while the textured surface 34' is applied to the opposing face of the rigid retainer disc 35'. The mode of operation of the regulator assembly will remain unchanged. In some cases, as a further variant, both the washer 32' and the retainer disc 35' may have opposing textured surfaces. In connection with all forms of the invention, it should be appreciated that the interstitial array produced by the textured surface or surfaces 34-34' contains a multitude of extremely minute communicating interstices, of the order of microns or fractional microns.

In all of the drawing figures, the operation of the pressure regulator is as follows. High pressure gas enters the grooves 36 as shown by the arrow in FIG. 2 and from these grooves enters the interstitial matrix at the interface between washer 32 and retainer disc 35. The gas moves radially inwardly to the opening 33 of the intermediate washer and then exits through the opening 30 of washer 29 and the port 31 in the end wall of the cavity or through the port 39 in the arrangement of FIG. 3.

A net pressure differential is effected (provided there is gas flowing in the system) due to the resistance to flow caused by the combination of a large surface area formed by the interstices of the textured surface 34 and the very small average size of the individual interstices. It is important that a tight seal be maintained between the washer 29 and the end wall 37 and likewise between the first and second washers 29 and 32 when the regulator is assembled, thereby restricting the flow of gas into the interstitial matrix only.

It is to be understood that the form of the invention herewith shown and described is to be taken as a preferred example of the same, and that various changes in the shape, size and arrangement of parts may be resorted to, without departing from the spirit of the invention or scope of the subjoined claims.

What is claimed is:

1. A gas pressure regulator for disposition in a housing member having a cavity including an end wall provided with a port comprising a pair of members of impervious material disposed within the cavity in face to face opposed mating engagement, one of said members being firm, an elastomeric washer having a central aperture therein positioned under compression with said cavity for biasing said pair of members toward each other and presenting a flat compressive surface to said abutting members, one of said members having an aperture therethrough communicating with said port and being a thin plastic material having its mating surface textured and being flexible across its width, said textured surface containing a multitude of extremely minute communicating interstices in the order of microns to fractional microns, thereby forming between said opposed mating surfaces an interstitial array of passages offering resistance to the gas flowing across the interface between said members, said gas flow being directed radially inward from the peripheries of said members to said firm member aperture, said elastomeric washer abutting said member with an aperture the central aperture of said elastomeric washer being larger in size than the aperture in said abutting member so that the degree of compression of said elastomeric washer that is transmitted to and hence by the compressed area of said thin flexible plastic member in turn controls the amount of mating surface area of said members that is under compression thereby determining the length of the gas flow path between, the mating compressed area of said members for regulating the gas pressure drop, and means providing a passageway for gas between the members and the housing.

2. A gas pressure regulator as defined in claim 1 and further characterized by means for selectively biasing the elastomeric washer.

3. A gas pressure regulator comprising a housing member having a cavity including an end wall provided with a port, the cavity also having at least one groove in its side wall surface, an elastomeric washer in the cavity and abutting said end wall and having a central aperture therein in communication with said port, an intermediate washer in the cavity having an aperture therethrough and formed of a thin impervious plastic material that is flexible across its width and abutting a flat compressive surface of the elastomeric washer and having a textured face away from the elastomeric washer, and a substantially firm impervious retainer disc fixedly disposed in the cavity in face to face contact with said textured face of the intermediate washer and forming therewith an interstitial array of passages offering resistance to a gas flowing across the interface between said intermediate washer and retainer disc, and the retainer disc being positioned in the cavity to maintain the elastomeric washer under some compression, the central aperture of said elastomeric washer being larger in size than the aperture in said intermediate washer so that the degree of compression of said elastomeric washer that is transmitted to and hence by the compressed area of said thin plastic flexible intermediate washer in turn controls the amount of mating surface area of said intermediate washer and said retainer disc that is under compression thereby determining the length of the gas flow path between the mating compressed area of said members for regulating the gas pressure drop.

4. A gas pressure regulator as defined in claim 3, and an adjustable rigid plug in the housing member forming said end wall of the cavity and having a port in communication with the central aperture of the elastomeric washer, means for adjusting the position of said plug relative to the elastomeric washer, said adjustable plug being operable to vary the degree of compression of the elastomeric washer to thereby increase or decrease the length of the gas flow path and consequently increase or decrease the resistance to gas flow in the regulator.

5. A gas pressure regulator as defined in claim 4, and said adjustable plug being screw-threaded and having screw-threaded engagement in the housing member.

6. A gas pressure regulator as defined in claim 3, and said elastomeric washer being formed of material which possesses a substantially greater thermal coefficient of expansion than the intermediate washer and retainer disc, whereby the regulator is rendered automatically adjustable in response to ambient temperature variations.

7. A gas pressure regulator as defined in claim 3, and the elastomeric washer being formed of rubber, the intermediate washer being formed of textured Mylar and the retainer disc being formed of metal.

8. A gas pressure regulator as defined in claim 7, and said housing member being formed from a thermoplastic.

9. A gas pressure regulator for disposition in a housing member having a cavity including an end wall provided with a port comprising a pair of firm members of imprevious material disposed within the cavity in face to face opposed mating engagement, one of said members being a thin sheet of material that is flexible across its width and the other being formed of a more rigid material, an elastomeric means having an aperture and positioned under compression within said cavity for biasing said pair of members toward each other, said thin flexible member having an aperture therethrough communicating with said aperture in said elastomeric means and said port and at least one of said members having its mating surface textured, said textured surface containing a multitude of minute communicating interstices, thereby forming between said opposed mating surfaces an interstitial array of passages offering resistance to the gas flowing across the interface between said members, said gas flow being directed radially inward from the peripheries of said members to said member aperture, said elastomeric means having a flat surface that is in abutting contact with said thin flexible member and having an available contact surface area less than that of said abutting member, said elastomeric means being capable of lateral expanded displacement relative to said abutting member upon an increase in compression to increase said abutting contact area of said elastomeric means so that the degree of compression of said elastomeric means that is transmitted to and hence by the compressed area of said thin flexible member in turn controls the amount of mating surface area of said members that is under compression thereby determining the length of the gas flow path between the mating compressed area of said members for regulating the gas pressure drop, and means providing a passageway for gas between the members and the housing.

10. A gas pressure regulator as defined in claim 9 and further characterized by means for selectively biasing the elastomeric means.

11. A gas pressure regulator as defined in claim 9 and further characterized by said thin flexible member having a textured surface that abuts said more rigid member.

12. A gas pressure regulator as defined in claim 9, and said more rigid member possessing a textured face on its side in contact with the thin flexible member.

* * * * *